US007292154B1

(12) United States Patent
Baier et al.

(10) Patent No.: US 7,292,154 B1
(45) Date of Patent: Nov. 6, 2007

(54) MONITOR AND METHOD FOR SENSING TEMPERATURE DIFFERENCES

(75) Inventors: Frederick A. Baier, Point Pleasant, NJ (US); Christopher Barton, Wall, NJ (US); Stephen Chapman, New York, NY (US)

(73) Assignee: Delta T Engineering, LLC, Metuchen, NJ (US)

( * ) Notice: Subject to any disclaimer, the term of this patent is extended or adjusted under 35 U.S.C. 154(b) by 215 days.

(21) Appl. No.: 11/295,182

(22) Filed: Dec. 7, 2005

(51) Int. Cl.
*G08B 17/00* (2006.01)

(52) U.S. Cl. ..... 340/584; 116/101

(58) Field of Classification Search ..... 340/584
See application file for complete search history.

(56) References Cited

U.S. PATENT DOCUMENTS 4,788,871 A * 12/1988 Nelson et al. ..... 73/866.5
4,901,060 A * 2/1990 Liu ..... 340/598
5,982,849 A * 11/1999 Bischof ..... 378/130

* cited by examiner

*Primary Examiner*—Jeffrey Hofsass
*Assistant Examiner*—Kerri McNally
(74) *Attorney, Agent, or Firm*—Thomas L. Adams

(57) ABSTRACT

A monitor can sense the difference in temperature between the inside and the outside of an enclosure containing electrical power equipment. The monitor has a case adapted for mounting at the enclosure. Also included is a first and a second sensor for producing a first signal and a second signal, respectively. The first sensor is mounted at the case and is adapted for insertion through an opening in the enclosure. The second sensor is adapted to sense temperature at a location remote from the first sensor. Specifically, the case is mounted so that one of the sensors is inside the enclosure and the other is outside. The monitor also includes an alarm system mounted at the case and coupled to the first and the second sensor for producing a warning signal in response to the first and the second signals from the first and the second sensor signifying a temperature difference exceeding a predetermined threshold.

27 Claims, 2 Drawing Sheets

MONITOR AND METHOD FOR SENSING TEMPERATURE DIFFERENCES

BACKGROUND OF THE INVENTION

1. Field of the Invention

The present invention relates to apparatus and techniques for detecting the temperature differential existing around various electrical power equipment and enclosures.

2. Description of Related Art

Residential, commercial, and industrial buildings typically have electrical panels in the form of a box or covered recess that may contain circuit breakers, power contactors, relays, fuses or other equipment designed to deliver or route primary utility current to locations in the building. Failure of such electrical equipment is typically preceded by a temperature increase. The temperature increase can be caused by excessive current, unbalanced load, oxidation or corrosion at contact surfaces, lossy contacts that generate heat, arcing, etc.

Measuring a temperature increase within an electrical panel is complicated by the fact that the temperature rise can be caused by equipment defects, or simply by a rise in the ambient temperature. For this reason equipment for detecting or anticipating equipment failure will measure a temperature difference, that is, the temperature at a piece of monitored equipment relative to ambient.

A disadvantage with measuring these temperature differences is the complexity associated with the equipment capable of performing such measurements. For example, monitoring the temperature inside a power panel will often require a skilled electrician who is able to remove the panel cover while energized and safely install a temperature sensor as well as wiring that leads to the outside of the power panel. Also, an external temperature sensor must be mounted outside the panel at a position appropriate for measuring ambient temperature. This external sensor must then be wired to a monitoring circuit that can perform the differential analysis and provide an appropriate warning signal. Being relatively complex, such systems often consume a fair amount of power and are therefore often connected to utility power lines, which adds to the complexity of the installation.

In U.S. Pat. No. 4,901,060 a temperature sensitive thyristor 34 energizes warning element 20 when high temperature is sensed at device 18, which is illustrated as a standard socket for house current. Warning element 20 can be a light or a flasher. A temperature reference can be provided to thyristor 34 by diode 64 of device 62, which is spaced a distance d from the thyristor 34.

In U.S. Pat. No. 6,470,735 the temperature of lubricant in an axle housing is measured by sensor 26 and compared to the ambient temperature measured by sensor 30. An excessive temperature difference indicates a probable need for service and can illuminate light 36.

In U.S. Pat. No. 5,541,803 a temperature difference is sensed by a sensor conductor and a reference conductor. In the embodiment of FIG. 17 a sensor conductor 174 is routed inside an appliance to compare the temperature inside the appliance to the temperature on the outside of the appliance. Power to the appliance is interrupted in response to excessive internal temperature. LEDs 32 and 33 indicate the status of the system as either "tripped" or "on."

In U.S. Pat. No. 6,707,652 a terminal of a circuit breaker (or the like) may glow hot if it has a poor, high resistance connection. Temperature sensing diodes 8 and 10 can sense the different temperatures and the magnitude of the difference determines whether the comparator will trip a circuit breaker coil.

In U.S. Pat. No. 5,982,849 a device adhesively attached to an x-ray tube can operate a blinker 11 when resistance sensor 7 detects a high temperature.

In U.S. Pat. Nos. 5,847,653 and 6,060,990 a heat alarm is attached to the face of an electrical panel by magnets or otherwise. A bimetallic switch senses temperature reaching 135° F. to illuminate an LED and operate an audible alarm.

In U.S. Pat. No. 5,461,367 a bimetallic temperature sensor is mounted inside an electrical panel to produce an audible alarm when the panel temperature exceeds 135° F.

In FIG. 4 of U.S. Pat. No. 4,331,888 temperature sensitive transistors Tr1 and Tr2 have different thermal time constants. Accordingly, a differential voltage will be produced in response to a rapid temperature increase. This differential voltage can trigger a temperature sensitive thyristor that can also trigger in response to high temperatures, without regard to the differential voltage. Once triggered, the thyristor operates an alarm 7.

In U.S. Pat. No. 4,406,550 temperature sensors 10 and 11 are applied to differential comparator 30 to display a temperature difference on display 38. The device is described as useful for monitoring temperature differences at different positions on a diesel engine, a furnace, a solar collector, or at different positions around a building (including the inside and outside of the building). If the temperature difference exceeds a certain positive threshold the system activates an alarm 55. If the temperature difference exceeds a certain negative threshold, alarm 56 is activated instead.

In U.S. Pat. No. 6,359,565 the temperatures at various locations on several electronic cards are monitored by sensors mounted on those cards. The measured temperatures are compared electronically to the ambient temperature measured at a fan. Components having a high temperature differential over the ambient temperature are deemed to be malfunctioning and the operator is given an alarm signal and is offered information in the form of a thermal map of the system.

In U.S. Pat. No. 5,081,359 a differential thermal sensor using thermopiles can detect temperature differences along a patient's spine, or in various industrial processes.

In U.S. Pat. No. 4,608,565 an indoor/outdoor thermometer uses a radio frequency connection to avoid cutting a hole through a building. Temperature is displayed by a numeric display.

In U.S. Pat. No. 3,688,295 a thermocouple for measuring brake temperature is compensated so that changes in ambient temperature due to cold or hot weather do not affect the temperature measurement at the hot junction of the thermocouple. As temperature increases the system illuminates a warning light and then an overheat light.

In U.S. Pat. No. 4,188,623 the hot junction of the thermocouple is placed near an automobile's catalytic converter. If the thermocouple measures a high temperature, reed switch 20 closes to illuminate light 26. The cold junction is responsive to the "circumferential temperature" but a temperature sensitive diode or thermistor is used to compensate for or cancel out the effects of the circumferential temperature.

In U.S. Pat. No. 5,229,612 a thermopile is coupled with a thermocouple so that a measured temperature is referenced to a remote temperature sensed by the thermocouple. In some embodiments separate thermopiles measure temperatures at spaced positions to develop a differential temperature measurement.

In U.S. Pat. No. 6,429,777 thermistors are mounted in junction boxes throughout a building. The measured temperatures can be displayed on a panel at a central station.

In U.S. Pat. No. 4,922,230 a reference temperature signal is initially set at startup and is allowed to vary slowly if temperature increases. The difference between this reference temperature and the actual temperature as sensed by the sensor 10 is used to trigger an alarm, basically when the sensed temperature is rising so fast as to indicate the outbreak of the fire.

In U.S. Pat. No. 3,753,194 a pair of thermostats produces a signal when the temperature falls between an upper and lower limit.

Accordingly, there is a need for an improved device for measuring temperature differences associated with electrical equipment that avoids the shortcomings and complexities of the prior art.

SUMMARY OF THE INVENTION

In accordance with the illustrative embodiments demonstrating features and advantages of the present invention, there is provided a monitor for sensing the difference in temperature between an inside and an outside of an enclosure containing electrical power equipment. The monitor has a case adapted for mounting at the enclosure. Also included is a first and a second sensor for producing a first signal and a second signal, respectively. The first sensor is mounted at the case and adapted for insertion through an opening in the enclosure. The second sensor is adapted to sense temperature at a location remote from the first sensor. The monitor also includes an alarm system mounted at the case and coupled to the first and the second sensor for producing a warning signal in response to the first and the second signals from the first and the second sensor signifying a temperature difference exceeding a predetermined threshold.

In accordance with another aspect of the invention a method is provided for sensing the difference in temperature between an inside and an outside of an enclosure containing electrical power equipment. The method employs a case having a pair of sensors for producing temperature signals. The method includes the step of mounting the case at the enclosure with one of the sensors inside the enclosure and the other outside. Another step is producing a warning signal in response to the signals from the first and the second sensor signifying a temperature difference exceeding a predetermined threshold.

By employing apparatus and techniques of the foregoing type an improved equipment monitor is achieved. In one embodiment a plastic case is fitted with a thermistor that projects from the front and another thermistor that projects from the back. The back thermistor is designed to fit through a hole in an enclosure. This hole can either pre-exist or can be drilled in preparation for installation of the case. The case may be mounted by integral magnets, adhesives, or other simple fastening means.

This case will include appropriate circuitry for sensing the temperature difference sensed by the inside and outside thermistors. The disclosed embodiment will have a trio of LEDs: green for normal, yellow for exceeding a first threshold, and red for exceeding a second higher threshold. To conserve the battery powering the system the lights will blink, with the green blinking once every 20 seconds, yellow blinking twice as fast and the red blinking three times as fast.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
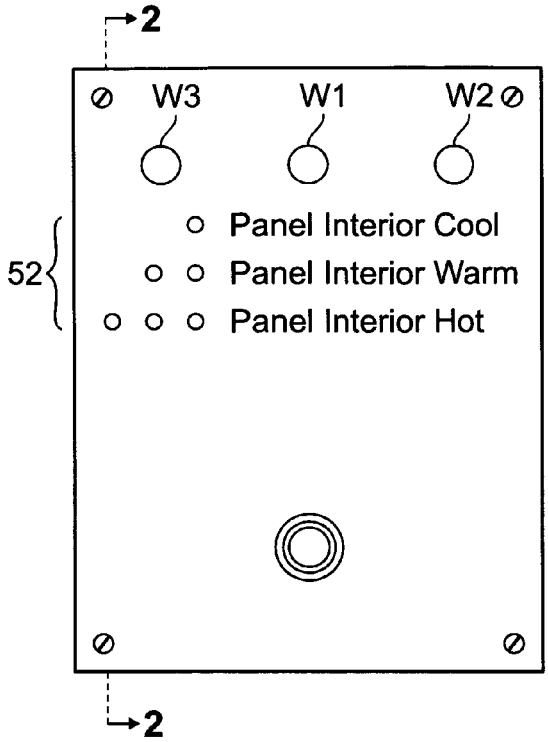
FIG. 1 is a front view of a monitor in accordance with principles of the present invention.
Figure 2:
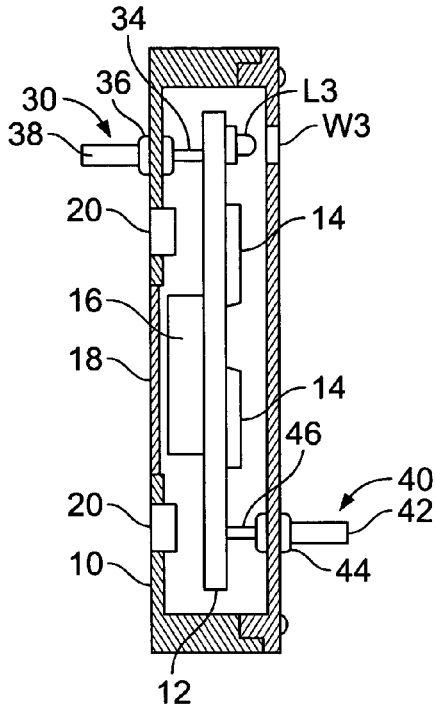
FIG. 2 is a vertical, cross-sectional view of the monitor of FIG. 1 taken along line 2-2 FIG. 1.

Referring to FIGS. 1 and 2, a monitor is shown as a case 10 containing a printed circuit board 12 with a number of integrated circuits 14 and a battery 16, all arranged to act as an alarm system. An access door 18 on the back of case 10 allows installation or replacement of battery 16. Mounted behind integral windows W1, W2, and W3 on circuit board 12 are a number of lights, one such light being shown herein as light emitting diode (LED) L3 mounted behind circular window W3 in the front of case 10.

Glued into openings in the back of case 10 are a pair of bar magnets 20 for magnetically securing case 10 to an enclosure made a steel or other ferromagnetic materials.

Figure 3:
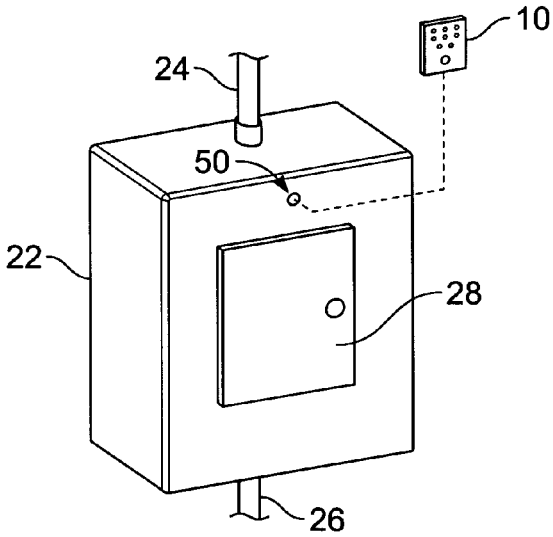
FIG. 3 is a perspective view of the monitor of FIG. 1 about to be mounted on an enclosure containing electrical power equipment.

Referring to FIG. 3, an exemplary enclosure is shown as a power panel in the form of a steel box 22 into which are routed power lines 24 and 26. Door 28 can be opened to gain access to electrical power equipment inside box 22. Such equipment can be circuit breakers, contactors, relays, transformers, or other equipment that may be useful in routing and delivering current from utility lines. In some embodiments the enclosure may encompass a relatively large volume containing electromagnetic motors, solenoids, etc. Instead of a discrete box, some embodiments may work with a recess built into the structure of a building, which is then covered by a metal plate or the like.

Figure 4:
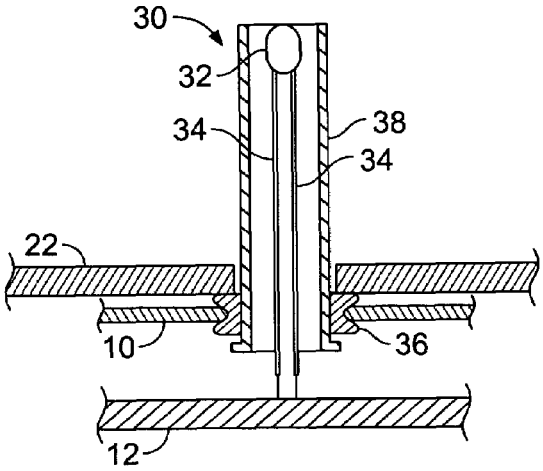
FIG. 4 is a cross-sectional view of the first sensor of the monitor of FIG. 2.
Figure 5:
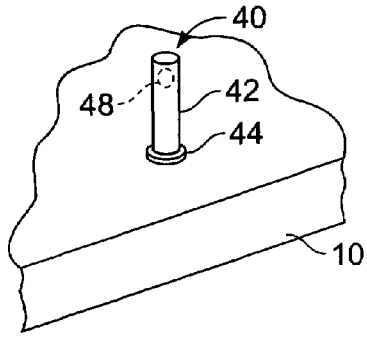
FIG. 5 is a fragmentary, perspective view of the second sensor of the monitor of FIG. 2.

Referring to FIGS. 2, 4, and 5, a first sensor 30 is shown as an encapsulated thermisistor 32 mounted on a pair of insulated wires 34, which are soldered into printed circuit board 12 for delivering a first signal thereto. The leads of thermistor 32 are routed through a thermally insulating grommet 36 mounted in a hole in the back of case 10. A plastic sleeve 38 having an inside flange is mounted in grommet 36 to protect thermisistor 32. In FIG. 5 a second sensor 40 identical to the one shown in FIG. 4 is mounted inside a plastic sleeve 42 and grommet 44, which are identical to previously mentioned sleeve 38 and grommet 36. Such grommets can be obtained from Mueller Die Cut Solutions of Charlotte, N.C. Sensor 40 has a thermisistor 48 that issues a second signal along wires 46.

Figure 6:
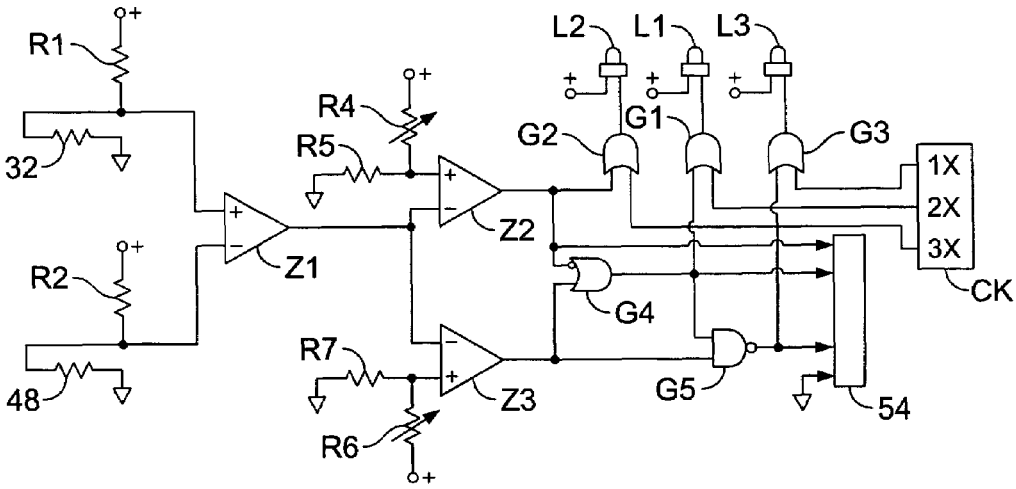
FIG. 6 is a schematic view of the circuit inside the monitor of FIG. 2.

Referring to FIG. 6, resistor R1 has one terminal connected to positive potential and its other terminal shunted to ground through previously mentioned thermistor 32 (first sensor). Resistor R2 has one terminal connected to positive potential and its other terminal shunted to ground through previously mentioned thermistor 48 (second sensor). The junction of elements 32 and R1 provide a first signal that is connected to the non-inverting terminal of differential amplifier Z1, whose inverting terminal connects to the junction of elements R2 and 48, which provides a second signal.

The output of differential amplifier Z1 commonly connects to the inverting terminals of comparators Z2 and Z3. The non-inverting terminal of comparator Z2 connects to the junction of serially connected variable resistor R4 and resistor R5, which connect between positive potential and ground, in that order. The non-inverting terminal of comparator Z3 connects to the junction of serially connected variable resistor R6 and resistor R7, which connect between positive potential and ground, in that order.

The output of comparator Z2 connects to one input of OR gate G2 whose other input connects to output 3X of clock circuit CK, whose other outputs are identified as outputs 1X and 2X. Outputs 1X, 2X and 3X produce square waves with a frequency of 3, 6, and 9 Hz, respectively (i.e., once, twice, and thrice every 20 seconds). Clock circuit CK may include a free running multivibrator with a divider, or three independent oscillators whose outputs are clipped.

Output 2X connects to one input of OR gate G1 whose other input connects to the output of OR gate G4 whose inverting and non-inverting inputs connect to the outputs of comparators Z2 and Z3, respectively. Output 1X connects to one input of OR gate G3 whose other input connects to the output of NAND gate G5. The output of gate G4 connects to one input of NAND gate G5, whose other input connects to the output of comparator Z3.

The outputs of gates G1, G2, and G3 connect to the cathodes of yellow LED L1, red LED L2, and green LED L3, whose anodes connect to positive potential. The square waves of clock CK may operate with a duty cycle of about 10% to reduce the amount of time the LEDs remain on.

To facilitate an understanding of the principles associated with the foregoing apparatus, its operation will be briefly described. The circuit of FIG. 6 is initially calibrated by raising the temperature of thermistor 12 F.° (6.7 C.°) relative to thermistor 48. The resulting increased resistance of thermistor 32 increases the potential at the non-inverting input of differential amplifier Z1 relative to its inverting terminal. Consequently, the output of amplifier Z1 increases. Next, variable resistor R6 is adjusted by increasing its resistance from a minimum value until the output of comparator Z3 changes from a high to a low value, i.e., from approximately the supply potential to 0 V.

After that, the temperature of thermistor 32 is increased to a temperature of 27 F.° (15 C.°) relative to thermistor 48. Again, the further increased resistance of thermistor 32 further increases the output of differential amplifier Z1. Then, variable resistor R4 is adjusted by increasing its resistance from a minimum value until the output of comparator Z2 changes from a high to a low value.

Once adjusted, comparators Z3 and Z2 provide a first and a second threshold, respectively, in the nature of a warning signal indicating that the temperature difference has exceeded predetermined limits. The specific temperature differences defining the first and second threshold may be established based upon the users' preferences. In conservative designs relatively small temperature differences will cross the thresholds. Also, the temperature difference corresponding to the thresholds will vary depending on the environment and the device being protected. As an example, the device may often be used to protect an enclosure that is 2 feet (61 cm) tall, 1.5 feet (46 cm) wide and 10 inches (25 cm) deep. For such an enclosure, an exemplary embodiment set the temperature difference for the first threshold at 5 F.° (2.8 C.°), while the temperature difference for the second threshold was set at a value in the range of 10 to 15 F.° (5.6 to 8.3 C.°). It will be appreciated that the foregoing temperature thresholds are by no means the only thresholds that may be selected and the actual thresholds employed will depend on the equipment being monitored, the expected temperature variations, the type of ventilation, the criticality of equipment failure, etc.

Also, comparators Z2 and Z3 can be designed with hysteresis so that once a comparator changes state it will not revert back to the earlier state until a significant temperature reversion is sensed (e.g., 0.5 C.°).

In the embodiment of FIG. 3 enclosure 22 is prepared by drilling a hole 50 in the face of the enclosure above door 28 (although in the hole may preexist in certain types of enclosures). It is desirable to install device 10 high on enclosure 22 since heat inside the enclosure will tend to rise and device 10 will then be monitoring what is normally the hottest part of the enclosure. Placement of device 10 on the front of the enclosure 22 is also desirable so that device 10 and its LED indicators are prominent and easily visible. On the other hand, the device can be mounted on other locations on enclosure 22. In some instances, device 10 may be mounted on the top surface of enclosure 22, in which case device 10 can be modified so that its LED indicators (visible through windows W1-W3) are located on the edge of the device to enhance visibility.

In the illustrated embodiment case 10 is placed on the front of enclosure 22 with the first sensor 30 inserted through hole 50. The length of sensor 30 is chosen to allow thermistor 32 to project inside enclosure 22 approximately 2.5 cm. Since enclosure 22 is in this case made of steel, magnets 20 will immediately attach case 10 to the enclosure without the need for further fastening means. For embodiments where the enclosure is not ferromagnetic, case 10 can be secured with glue, double sided tape, etc. Also, in some embodiments case 10 may be formed with screw holes (or flanges with screw holes) that allow the case to be fastened to an enclosure with screws or other fastening devices.

Once case 10 is installed, the interior of enclosure 22 will reach an equilibrium that under normal circumstances is no more than 3 C.° warmer than the ambient temperature outside the enclosure. Accordingly, the output of differential amplifier Z1 (FIG. 6) will be relatively small so that the output of comparators Z2 and Z3 will be high. These high outputs produce high outputs on OR gates G1, G2, and G4, which produces a zero potential across LEDs L1 and L2, keeping them off.

The high outputs from comparator Z3 and gate G4 produces a low signal from gate G5, which is applied to one input of gate G3. The other input of gate G3 receives from output 1X of clock CK square waves with a period of 20 seconds. Consequently, gate G3 applies the same square waves to the cathode of green LED L3, which then blinks at the rate of once every 20 seconds.

If however there is a failure, an imminent failure, or some other thermal problem inside enclosure 22, the temperature inside enclosure 22 will increase. When the temperature differential exceeds a threshold of approximately 6.7 C.°. Output of comparator Z3 becomes low. Since the output of comparator Z2 remains high, OR gate G4 applies a low output signal to one input of OR gate G1. Since the other input of gate G1 is receiving the square waves from output 2X of clock CK, gate G1 applies the same square waves to the cathode of yellow LED L1, which blinks at the same rate, i.e., twice every 20 seconds. Also, because comparator Z3 applies a low signal to one input of NAND gate G5, this gate produces a high signal that is conveyed through gate G3 to the cathode of green LED L3, keeping it off.

If the temperature differential increases beyond the threshold of approximately 15 C.°, comparator Z2 now produces a low signal indicating passage through the second threshold. The low output from comparator Z2 produces a high output on gates G4 and G1, turning off yellow LED L1, but without further affect on green LED L3, which remains off. The low output of comparator Z2 is applied to one input of OR gate G2 whose other input receives the square wave from the output 3X of clock CK. Consequently, gate G2 applies the same square wave to the cathode of red LED L2, which then blinks at the rate of three times every 20 seconds.

Service or maintenance personnel can easily determine whether the temperature in the interior of enclosure 22 is suspiciously high relative to the ambient temperature outside the enclosure. Personnel familiar with the legend 52 (FIG. 1) will know that a cool condition, graphically indicated by a single green circle on the first line of legend 52, is indicated by the green LED slowly blinking through window W3. A warm condition, indicated on the second line of legend 52 by two yellow circles, corresponds to the yellow LED blinking twice as fast through window W1. A hot condition, indicated on the third line of legend 52 by 3 red circles, corresponds to the red LED blinking three times as fast through window W1. Since a blinking light attracts attention, personnel can determine the condition of the protected equipment at a glance. Also, the fact that during normal conditions the green LED L3 (FIG. 6) only blinks once every 20 seconds, conserves power, so that under normal conditions the life of battery 16 (FIG. 2) can be one or more years. Long battery life may be promoted by using durable batteries such as those provided by Micropower Battery Company of Miami Fla.

In some cases the three foregoing conditions as indicated by the three LEDs L1, L2, and L3, may be sent electronically to a building management system or a building alarm system. For this purpose, connector 54 is provided for conveying the signals from the outputs of elements Z2, G4, and G5. In more complicated systems, connector 54 may include a digital processor for multiplexing the signals, producing an RS-232 output, or other signals conditioned as appropriate for interfacing with another system.

It is appreciated that various modifications may be implemented with respect to the above described, preferred embodiment. While the foregoing system employs simple combinational logic, other embodiments may employ a microprocessor programmed to control system operations. Alternatively, an EEPROM can be programmed to produce the foregoing logical events. Furthermore, all of the foregoing components may be integrated into a single integrated circuit (an ASIC), with the possible exception of the temperature sensors and battery. In some embodiments the alarm system may have a delay circuit, counter or filter to prevent production of a warning signal in case of an intermittent event. Also, instead of a differential amplifier, the thermistors can be connected in a bridge whose output connects to the rest of the circuit either directly or through an amplifier. Instead of thermistors, some embodiments can employ thermocouples, temperature sensitive semiconductors, bimetallic components, etc. Moreover, some embodiments may employ an audible alarm, instead of, or in addition to, a warning light. The shape, size, configuration, and material composition of the foregoing case can be altered depending upon the size of the circuit components, available space, desired case strength, etc.

Obviously, many modifications and variations of the present invention are possible in light of the above teachings. It is therefore to be understood that within the scope of the appended claims, the invention may be practiced otherwise than as specifically described.

The invention claimed is:

1. A monitor for sensing the difference in temperature between an inside and an outside of an enclosure containing electrical power equipment, comprising:

a case adapted for mounting at said enclosure;

a first sensor for producing a first signal, said first sensor being mounted at said case to project therefrom in an insertional direction and being adapted for insertion through an opening in said enclosure;

a second sensor for producing a second signal, said second sensor being adapted to project from said case in a direction different from said insertional direction and to sense temperature at a location remote from said first sensor; and alarm system mounted at said case and coupled to said first and said second sensor for producing a warning signal in response to the first and the second signals from said first and said second sensor signifying a temperature difference exceeding a predetermined threshold.

2. A monitor according to claim 1 wherein said first sensor and said second sensor project from the case in opposite directions.

3. A monitor according to claim 2 wherein said case has a front and a back, the first and the second sensor projecting from the back and the front, respectively, of said case.

4. A monitor according to claim 1 wherein said first sensor is adapted for insertion into the inside of said enclosure, the second sensor being located outside said enclosure.

5. A monitor according to claim 1 wherein said enclosure has a wall, the monitor comprising:

a magnet attached to said case for holding said case to the wall of the enclosure.

6. A monitor according to claim 1 wherein said first and said second sensor each comprise a thermistor.

7. A monitor according to claim 6 comprising:

a pair of thermal insulating grommets mounted in a pair of holes in said case, the first and the second sensor projecting through separate corresponding ones of said grommets.

8. A monitor according to claim 1 wherein said alarm system includes:

at least two warning devices, one being operated upon a temperature difference sensed by the first and the second sensors exceeding a first threshold, the other one being operated upon a temperature difference exceeding a second threshold.

9. A monitor according to claim 8 wherein the at least two warning devices include:

a first light and a second light, said alarm system flashing said first light upon the first threshold but not the second threshold being exceeded, said alarm system flashing said second light upon the second threshold being exceeded.

10. A monitor according to claim 9 wherein said alarm system includes:

a third light flashed by the alarm system when neither the first nor the second threshold are exceeded.

11. A monitor according to claim 10 wherein said alarm system flashes said first light slower than said first light and faster than said third light.

12. A monitor according to claim 11 comprising:

a battery coupled to said alarm system, the first, second and third light each emitting a different color light.

13. A monitor according to claim 8 wherein said alarm system includes:

a data port adapted to connect to a building management system.

14. A monitor according to claim 8 wherein said alarm system includes:

a data port adapted to connect to a building alarm system.

15. A method for sensing the difference in temperature between an inside and an outside of an enclosure containing electrical power equipment and employing a case having a pair of sensors for producing temperature signals, the method comprising the steps of:

mounting the case at said enclosure with one of the sensors inside the enclosure and the other outside, the sensors separately projecting from the case in an insertional direction and a direction different therefrom, the insertional direction being oriented to traverse the enclosure; and producing a warning signal in response to the signals from said first and said second sensor signifying a temperature difference exceeding a predetermined threshold.

16. A method according to claim 15 comprising the step of:

drilling a hole that communicates between the inside and outside of the enclosure; and mounting the case at the enclosure to allow one of the sensors to project though the hole.

17. A method according to claim 16 wherein the step of drilling a hole is performed on the face of the enclosure.

18. A method according to claim 16 wherein the step of mounting the case is performed by mounting the case outside the enclosure and inserting one of the sensors through the hole to sense temperature inside the enclosure, the other sensor remaining outside the enclosure.

19. A method according to claim 18 wherein the step of mounting the case is performed by magnetically attaching the case to the enclosure.

20. A method according to claim 15 employing two warning devices, comprising the steps of:

operating one of the warning devices upon a temperature difference sensed by the sensors exceeding a first threshold; and operating the other one of the warning devices upon a temperature difference exceeding a second threshold.

21. A method according to claim 20 wherein the two warning devices are warning lights, comprising the steps of:

flashing one of the warning lights upon the first threshold but not the second threshold being exceeded; and flashing the other one of the warning lights upon the second threshold being exceeded.

22. A method according to claim 21 employing a third light and comprising the step of:

flashing the third light when neither the first nor the second threshold are exceeded.

23. A method according to claim 22 wherein the warning lights are flashed at different rates, the third light being flashed more slowly than the warning lights.

24. A method according to claim 20 comprising the step of:

sending data derived from the sensors to a building management system.

25. A monitor according to claim 20 comprising the step of:

sending data derived from the sensors to a building and/or home alarm system.

26. A monitor for sensing the difference in temperature between an inside and an outside of an enclosure containing electrical power equipment, comprising:

a case having a front and a back, and adapted for mounting at said enclosure;

a magnet attached to said case for holding said case to the enclosure;

a first thermistor sensor for producing a first signal, said first thermistor sensor being mounted at said case and adapted for insertion through an opening in said enclosure into the inside of said enclosure;

a second thermistor sensor located outside said enclosure for producing a second signal, said second thermistor sensor being adapted to sense temperature at a location remote from said first sensor, a pair of thermal insulating grommets mounted in a pair of holes in said case, the first and the second thermistor sensor projecting through separate corresponding ones of said grommets, said first sensor and said second thermistor sensor projecting in opposite directions from the back and the front, respectively, of said case; and a battery powered alarm system mounted at said case and coupled to said first and said second thermistor sensor for producing a warning signal in response to the first and the second signals from said first and said second sensor signifying a temperature difference exceeding a first and a second threshold, said alarm system including:

a first light and a second light, said alarm system flashing said first light upon the first threshold but not the second threshold being exceeded, said alarm system flashing said second light upon the second threshold being exceeded;

a third light flashed by the alarm system when neither the first nor the second threshold are exceeded the first second and third light each emitting a different color light, said alarm system flashing said first light slower than said first light and faster than said third light; and a data port adapted to communicate information about the state of the alarm system.

27. A monitor according to claim 1 wherein said first sensor is adapted for insertion into the inside of said enclosure and is cantilevered on said case.

* * * * *